US006577834B2

(12) United States Patent
Suzuki

(10) Patent No.: US 6,577,834 B2
(45) Date of Patent: Jun. 10, 2003

(54) TWO-COMPONENT DEVELOPING DEVICE, IMAGE FORMING APPARATUS, AND STIRRING SCREW THEREOF

(75) Inventor: Eiji Suzuki, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/768,176

(22) Filed: Jan. 24, 2001

(65) Prior Publication Data

US 2002/0009309 A1 Jan. 24, 2002

(30) Foreign Application Priority Data

Jul. 19, 2000 (JP) ..... 2000-218470

(51) Int. Cl.[7] ..... G03G 15/08
(52) U.S. Cl. ..... 399/254; 399/256
(58) Field of Search ..... 399/254, 256, 399/255

(56) References Cited

U.S. PATENT DOCUMENTS

| | | | | |
|---|---|---|---|---|
| 4,707,107 A | * | 11/1987 | Joseph | 399/256 |
| 4,887,132 A | * | 12/1989 | Joseph et al. | 399/256 |
| 5,495,320 A | * | 2/1996 | Araki et al. | 399/256 |
| 5,682,584 A | * | 10/1997 | Hattori et al. | 399/256 X |
| 5,963,766 A | * | 10/1999 | Okuno et al. | 399/256 |

FOREIGN PATENT DOCUMENTS

| | | | |
|---|---|---|---|
| JP | 60-163455 | | 10/1985 |
| JP | 61-200841 | | 9/1986 |
| JP | 61-178923 | | 11/1986 |
| JP | 2-18585 | * | 1/1990 |
| JP | 5-127519 | | 5/1993 |
| JP | 8-44173 | * | 2/1996 |
| JP | 9-80886 | | 3/1997 |
| JP | 10-149007 | | 6/1998 |
| JP | 11-24404 | | 1/1999 |
| JP | 11-015245 | | 1/1999 |

* cited by examiner

*Primary Examiner*—Fred L Braun
(74) *Attorney, Agent, or Firm*—Armstrong, Westerman & Hattori, LLP

(57) ABSTRACT

A two-component developing device to stir a developer with toners so as to fully and evenly stir the toners. The two-component developing device developer carrying members (1 to 3) for carrying the developer (130) containing carriers and toners, to a latent image carrier (12), a stirring and carrying screw (6) for stirring the toners with the developer. The stirring and carrying screw (6) includes a screw shaft, a spiral screw (61) with a relatively short diameter, and another spiral screw (62) with a relatively long diameter, which are alternately wound around the same screw shaft. By arranging the short-diameter spiral screw (61) as a member for stirring the surface layer of the developer, the developer can be fully stirred while being carried on the face of a blade thereof.

13 Claims, 16 Drawing Sheets

TWO-COMPONENT DEVELOPING DEVICE, IMAGE FORMING APPARATUS, AND STIRRING SCREW THEREOF

BACKGROUND OF THE INVENTION

1. Field of the Invention

The present invention relates to a two-component developing device, an image forming apparatus, and a stirring screw, which are used in an electrophotographic device, etc., and more particularly to a two-component developing device, an image forming apparatus, and a stirring screw, which are used for enhancing an efficiency of stirring two component developers to improve an image printing quality.

2. Description of the Related Art

Recently, the image forming apparatus used in the electrophotographic system has been widely used as an output device connected to a computer. This image forming apparatus has required a high-speed printing performance. Therefore, the developing device also has required a high performance appropriate for high-speed printing.

A general electrophotographic method used in an image forming apparatus comprises the following steps:

charging a photosensitive carrier with electricity;

exposing by light the photosensitive carrier to form a latent image thereon;

supplying developers to the photosensitive carrier to develop the latent image;

transferring a toner image on a medium; and fixing the toners onto the medium.

In order to develop the latent image, a two-component developing device that uses toners and carriers is utilized. A toner concentration sensor is arranged in the two-component developing device, and this developing device performs to control the toner supply amount corresponds to the toner consumption for printing from a toner hopper. This is called a toner concentration control the two-component developing method enables the toners to be used by mixing and stirring the metallic-powder contained carriers with the resin toners to friction-charge these carriers and toners with electricity. Thus, a member for mixing and stirring these carriers and toners is arranged in the two-component developing device.

FIG. 22 is a constitutional view of a stirring screw in a conventional developing device, FIG. 23 is an explanatory view of the operation of the stirring screw, and FIG. 24 is a constitutional view of a stirring screw in another conventional developing device. As shown in FIG. 22, a stirring screw 100 comprises a shaft 120 and a long-diameter spiral screw blade 110 wound around the shaft 120. By rotating the screw 100, the developer 130 is stirred and moved while being in friction-contact with the blade 110. As shown in FIG. 23, by rotating the screw 100, the developer 130 is stirred-and moved while being in friction-contact with a single face of the blade 110. In this process of stirring and moving the developer 130, the supplied toners 150, which are supplied from the toner hopper, can be stirred with the developer 130 containing the carriers and the toners, and can be also charged with electricity.

On the other hand, the high-speed printer requires a large toner consumption per hour, so both the toner supply count and the toner supply amount are increased. Therefore, as shown in FIG. 22, when the stirring speed of the screw 100 is lower than the toner supply count or the toner supply amount, light-weight resin toners tend to collect upon an upper surface layer 140 of the developer 130 even by rotating the screw 100. Such toners are not fully friction-charged with electricity, so they are uncharged. These uncharged toners are easily scattered and attach to other portions except the desired latent image to lower an image printing quality.

As shown in FIG. 24, it is proposed that pins 160 should be arranged between the spiral blades 110 around the rotary shaft 120 to enhance the stirring ability. Using this constitution enables the developer 130, which is carried by the spiral blade 110, to be stirred even with the pins 160, so the stirring ability is expected to be enhanced.

This image forming apparatus requires a high performance for high-speed printing. For example, the image forming apparatus needs to have the ability of printing 400 or more sheets per minute. When an image is formed at high speeds, not only the toner consumption per hour is increased but also the toner supply amount and the toner supply count are increased. Therefore, there is a problem that using the constitution in FIG. 24 enables the toners to be stirred in the positions of the pins 160 arranged, but not to be stirred between the pins 160, so the high-speed printer cannot perform a sufficient stirring ability.

Furthermore, there is another problem that the developer 130 is subject to stress to shorten the developer's life because the pins 160 traverse the direction in which the blade 110 carries the developer 130. For example, the coated layers of the carriers are subject to abrasion to easily lower the friction-charging ability.

SUMMARY OF THE INVENTION

It is an object of the present invention is to provide a two-component developing device, an image forming apparatus, and a stirring screw, for enhancing the stirring ability and forming an image at high speeds.

It is another object of the present invention to provide a two-component developing device, an image forming apparatus, and a stirring screw, for enhancing the stirring ability and lowering a stress exerted on the developer.

It is another object of the present invention to provide a two-component developing device, an image forming apparatus, and a stirring screw, for enhancing the stirring ability with an inexpensive constitution.

In order to this object, a two-component developing device of the present invention comprises a developer carrying member for carrying a developer containing carriers and toners, to a latent image carrier, and a stirring screw for stirring supplied toners with the developer. The stirring screw comprises a screw shaft, a spiral screw with a relatively short diameter, and another spiral screw with a relatively long diameter, wherein these two spiral screws are alternately wound around the same screw shaft.

According to the present invention, it is focused on the fact that the generation of uncharged toners due to the increased toner supply amount is caused by the event that toners are carried to the upper and lower surface layers of the developer with different concentrations, because a long-diameter spiral screw has a sufficient ability of carrying the entire developer, but does not have a sufficient ability of stirring the upper surface layer of the developer as described above. Thus, a fundamental conception of the present invention is to arrange a member for stirring the upper surface layer of the developer, between the long-diameter spiral screw blades.

The surface layer of the developer can be stirred even with the conventional rotary pins, but the rotary pins are in point-contact with the developer, have a low stirring ability, and traverse the direction in which the long-diameter spiral screw carries the developer. At the result, the developer tends to receive a stress and is deteriorated. When the number of pins is increased to enhance the stirring ability, this tendency causes the developer to receive more stress. However, according to the present invention, by arranging a short-diameter spiral screw as a member for stirring the surface layer of the developer, the developer can be stirred while being carried on the face of a short-diameter spiral screw blade. Therefore, the short-diameter spiral screw can fully stir the surface layer of the developer without exerting a stress on the developer, so that the generation of uncharged toners can be prevented and the high-speed image printing quality can be improved.

According to the present invention, the outer diameter of the short-diameter spiral screw blade is shorter 10% to 80% than that of the long-diameter spiral screw blade. Therefore, the surface layer of the developer can be stirred in a wide range of the developing device.

Furthermore, according to the present invention, the outer diameter of the short-diameter spiral screw blade is shorter 10% to 20% than that of the long-diameter spiral screw blade. Therefore, the surface layer of the developer can be fully stirred in a range of developer amount fluctuation limited within the developing device.

BRIEF DESCRIPTION OF THE DRAWINGS

FIG. 10 is an explanatory view of the stirring effects to be obtained from the stirring screw in FIG. 5.

DESCRIPTION OF THE PREFERRED EMBODIMENTS

As the preferred embodiments of the present invention, an image forming apparatus, a stirring screw, and other embodiments are explained below with reference to the drawings as attached.

[Image Forming Apparatus]

Figure 1:
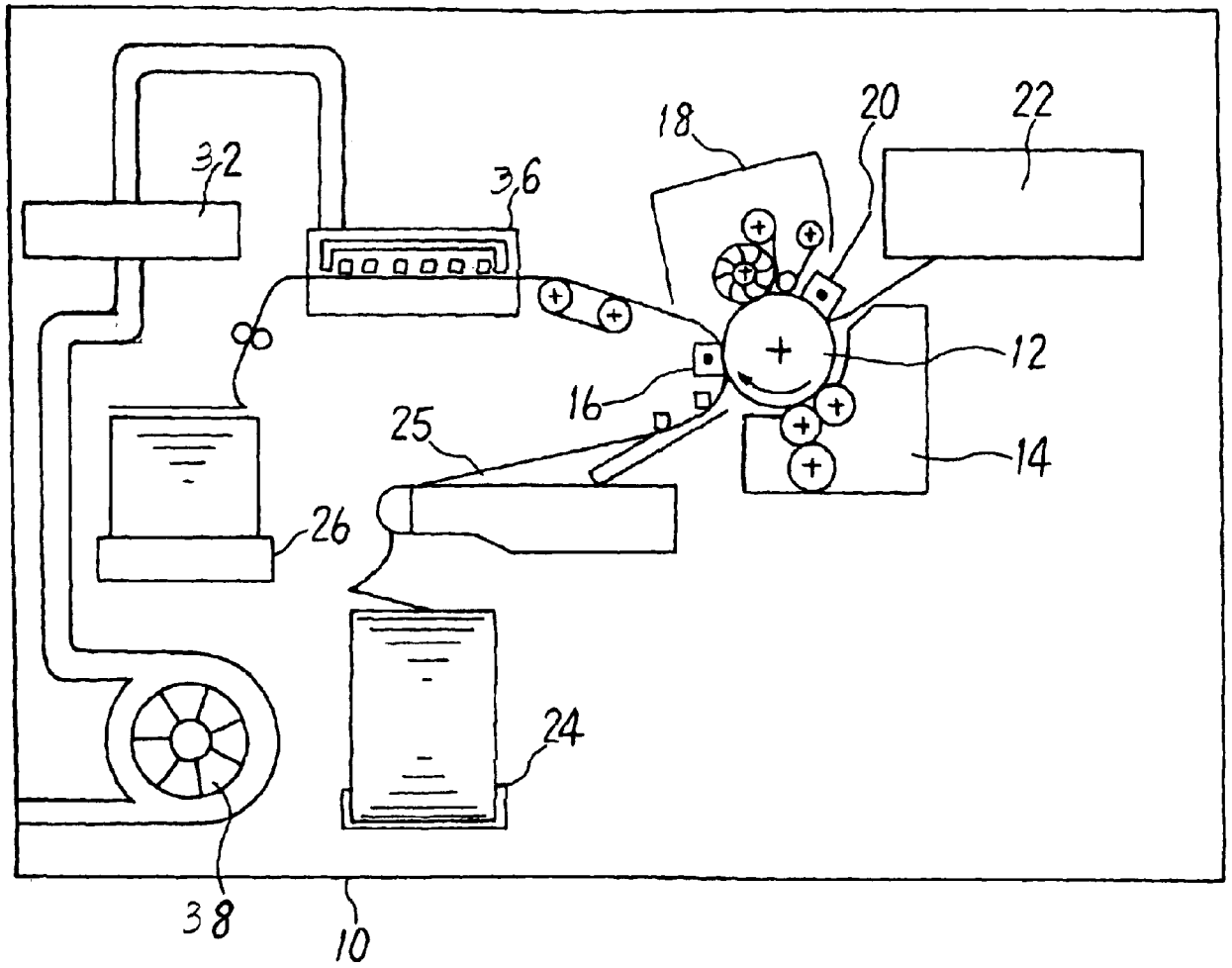
FIG. 1 is a constitutional view of an image forming apparatus according to an embodiment of the present invention.
Figure 2:
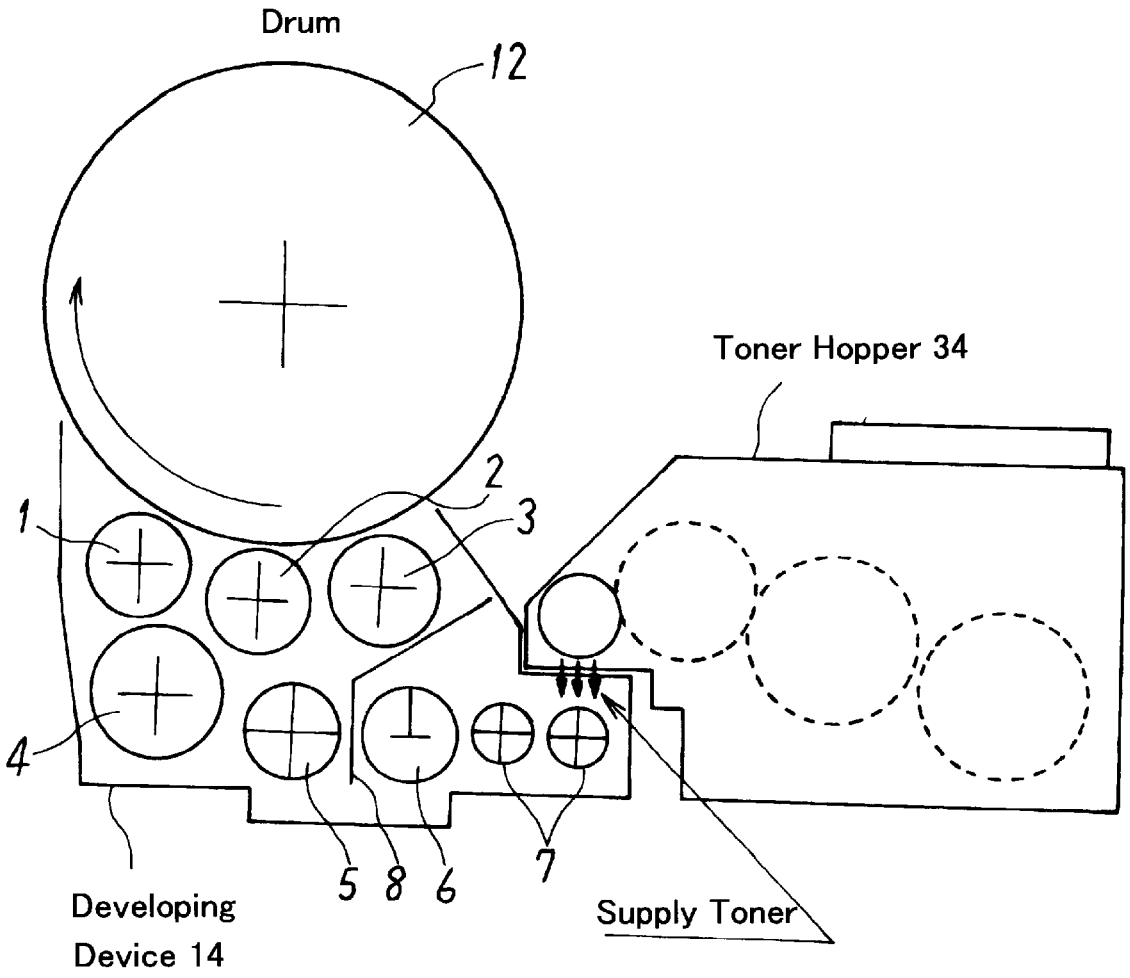
FIG. 2 is a constitutional view of a two-component developing device in FIG. 1.
Figure 3:
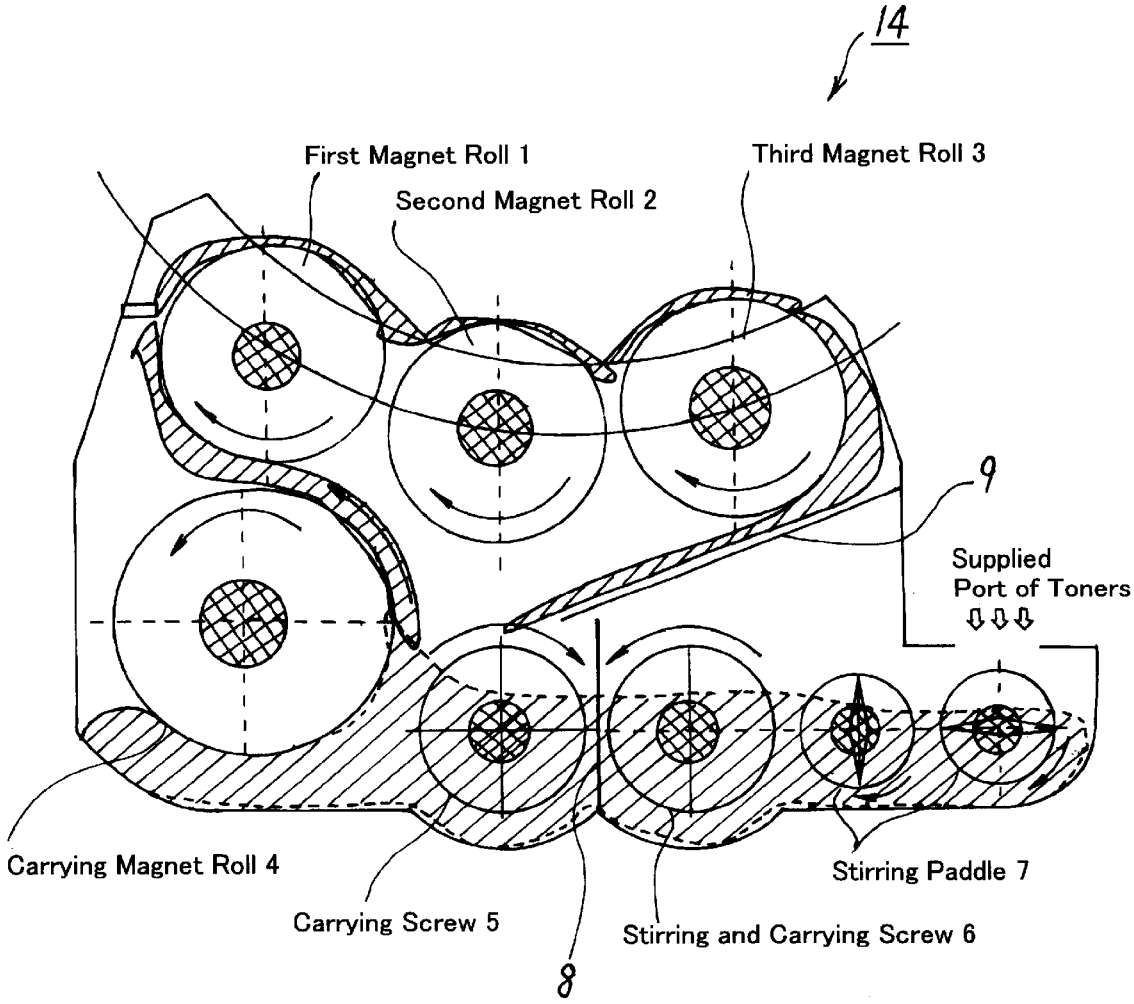
FIG. 3 is an enlarged view of the developing device in FIG. 2.
Figure 4:
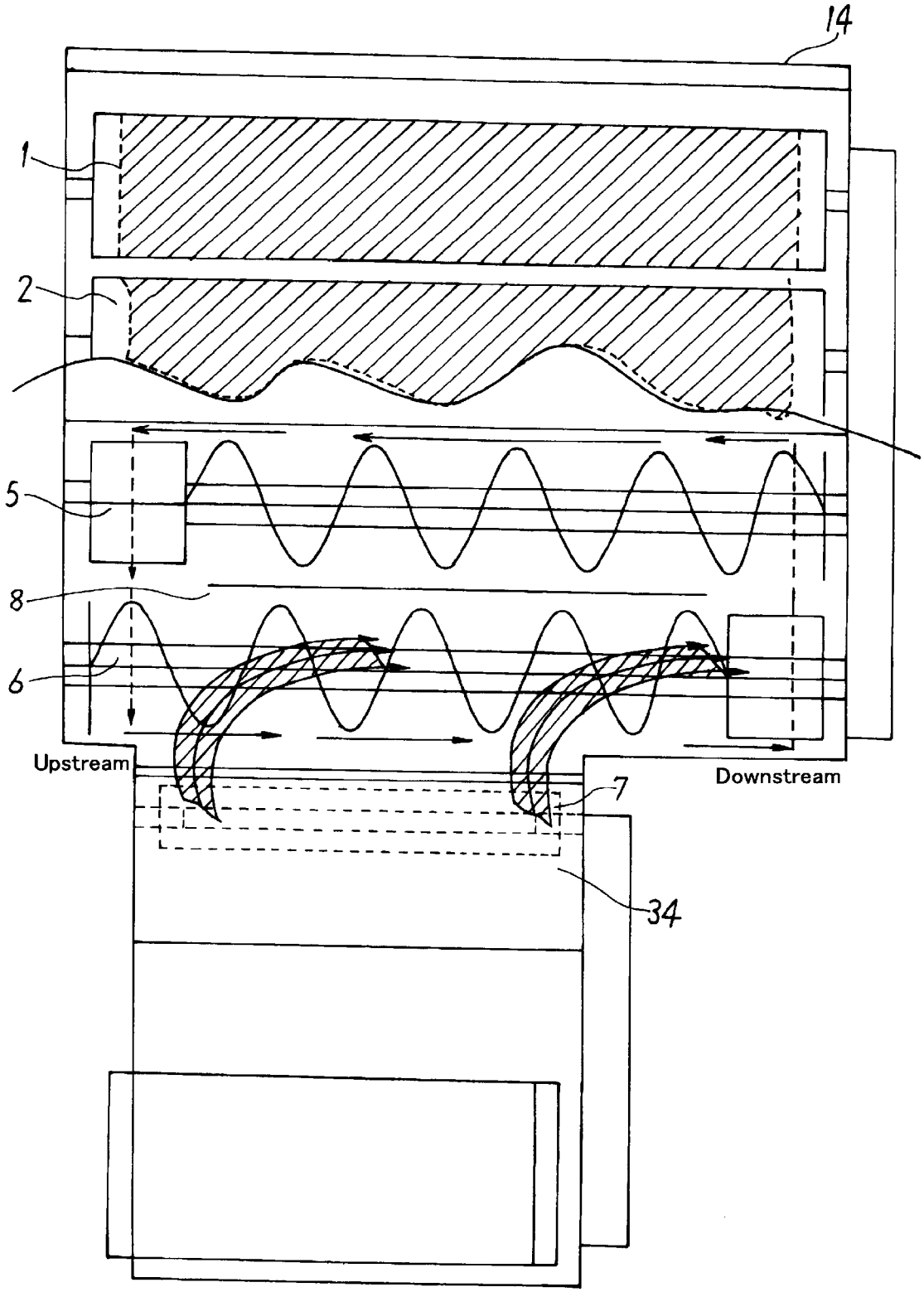
FIG. 4 is a top plan view of the two-component developing device in FIG. 3.

Referring to the attached drawings, FIG. 1 is a constitutional view of an image forming apparatus as an embodiment of the present invention, FIG. 2 is a constitutional view of a two-component developing device in the image forming apparatus, FIG. 3 is an enlarged view of the developing device body in FIG. 2, and FIG. 4 is a top plan view of the two-component developing device in FIG. 2.

FIG. 1 shows an example of an image forming apparatus used in a printer 10 comprising an electrophotographic mechanism. After a charger 20 charges a photosensitive drum 12 with electricity, a laser exposure device 22 exposes by lighting an image on the photosensitive drum 12 to form a latent image thereon. A two-component developing device body 14 carries a two-component developer to the photosensitive drum 12 to develop the latent image into a toner image. A transfer device 16 transfers the toner image on the photosensitive drum 12, to a sheet 25. After the toner image is transferred to the sheet 25, a cleaning mechanism 18 discharges the electricity from the photosensitive drum 12 and removes the residual toners therefrom.

The sheet 25 is a continuous paper stacked in a hopper 24. The sheet 25 stacked in the hopper 24 is fed to a transfer position to which the toner image is transferred, and then accommodated in a stacker 26 after passing through a flash fixing device 36. The flash fixing device 36 fixes the toner image onto the sheet 25, using the optical energy of flashes.

The printer 10 can execute a high-speed printing, which enables 40,000 or more lines to be printed per minute. Therefore, the printer 10 sublimates a large amount of toners during the flash fixing process. To remove this sublimated component, a filter 32 and a ventilating fan 38 are arranged in the printer 10.

An inorganic-sensitized body such as amorphous silicone, selenium, etc., and an organic-sensitized body such as polysilane, phthalocyanine, etc. can be used as photosensitive bodies. Particularly, the amorphous silicone sensitized bodies are favorably used, viewing from the "long life thereof."

Referring to FIG. 2, the two-component developing device 14 comprises a developing device body 14 and a toner hopper 34. An unshown toner bottle fills the toners into the toner hopper 34. Depending on the toner concentration detected by an unshown toner concentration sensor in the developing device body 14, the toner hopper 34 supplies the toners to the developing device body 14 so as to keep the toner concentration constant in the developing device body 14.

Referring to FIGS. 2 and 3, the two-component developing device body 14 comprises three developing magnet rolls 1, 2, and 3. Each of the developing magnet rolls 1, 2, and 3 carries a two-component developer containing carriers and toners to the photosensitive drum 12 so as to develop the latent image on the photosensitive drum 12 in to a toner image. This developing device body 14 has the developing area three times as large as that of the conventional developing device, so the latent image on the photosensitive drum 12 can be developed satisfactorily into the toner image even when the photosensitive drum 12 is rotated at high speeds for high-speed printing.

A carrying conveyor magnet roll 4 is arranged under a first developing magnet roll 1. The carrying conveyor magnet roll 4 carries the developer in the developing device body 14 to the first developing magnet roll 1. A carrying screw 5 is arranged beside the carrying conveyor magnet roll 4. The developer is returned to the stirring screw 5 from the third developing magnet roll 3 through a guide 9, the stirring screw 5 carries the developer in one direction by rotating in the direction opposite to the carrying conveyor magnet roll 4.

A stirring and carrying screw 6 is rotated in the direction opposite to the carrying screw 5 to carry the developer in the opposite direction. A partition plate 8 is arranged between the carrying screw 5 and the stirring and carrying screw 6 so as to circulate the developer through the developing device body 14 by rotating the carrying screw 5 and the stirring and carrying screw 6. A pair of paddles 7 stir and loosen the toners to be supplied from a toner supply port of the toner hopper 34, and carry the supplied toners to the stirring and carrying screw 6.

Therefore, the developer is supplied to the first developing magnet roll 1 through the carrying conveyor magnet roll 4, and carried from the first developing magnet roll 1 to the second and third developing magnet rolls 2 and 3, and returned to the carrying screw 5 through the guide 9.

Referring to FIG. 4, the supplied toners from the toner hopper 34 are supplied to and stirred by the stirring paddles 7, and then carried to the stirring and carrying screw 6. The stirring and carrying screw 6 stirs the toners with the developer carried from the carrying screw 5 through an end of the partition plate 8, and returns the developer to the carrying screw 5 from the other end of the partition plate 8 to circulate the developer through the developing device body 14.

The toner supply port of the toner hopper 34 has a relatively wide opening, the size of which is smaller than the width of the developing device body 14 so as to prevent the lumps of toners from being supplied. Therefore, the toners supplied from the toner hopper 34 to the downstream side in the developer carrying direction of the developing device body 14 cannot be fully stirred because of the short stirring distance of the stirring and carrying screw 6.

[Stirring Screw]

Figure 5:
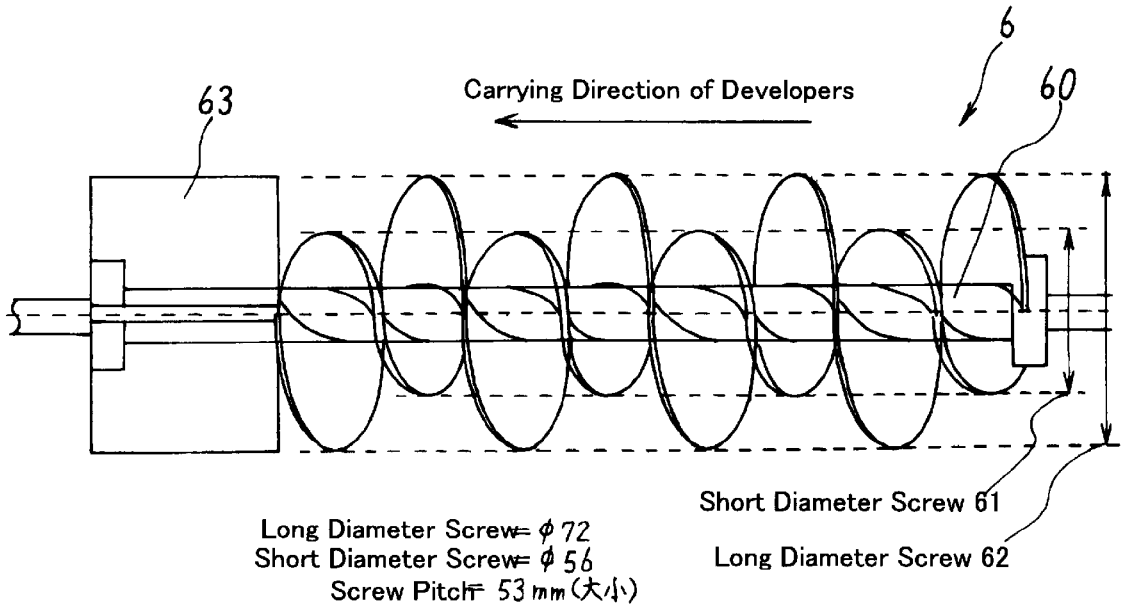
FIG. 5 is a constitutional view of a stirring screw according to an embodiment of the present invention.
Figure 6:
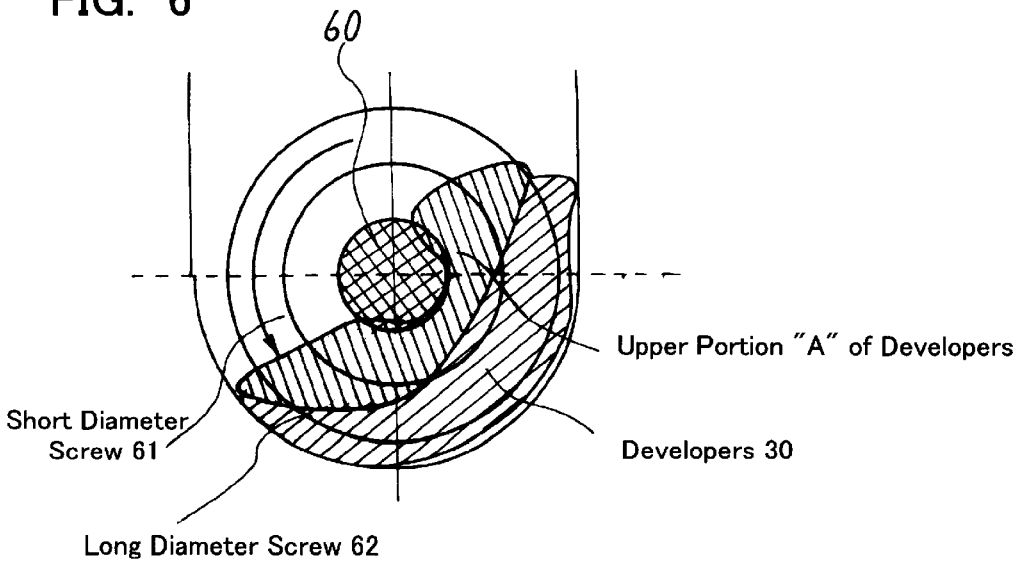
FIG. 6 is a sectional view of the stirring screw in FIG. 5.

FIG. 5 is a constitutional view of a stirring and carrying screw 6 as an embodiment of the present invention, FIG. 6 is a sectional view of the stirring and carrying screw 6, and FIGS. 7 to 10 are explanatory views of the operations of the stirring and carrying screw 6.

Referring to FIG. 5, the stirring and carrying screw 6 comprises a rotary shaft 60, a spiral screw 62 with a relatively long diameter, and another spiral screw 61 with a relatively short diameter. The spiral screws 61 and 62 are alternately wound around the rotary shaft 60. For example, the outer diameter of a long-diameter spiral screw blade 62 is 72 mm, and that of a short-diameter spiral screw blade 61 is 56 mm, and the screw pitch is 53 mm. The paddles are indicated by reference number 63.

Referring to FIG. 6, the relationship between a developer 130 and both the short-diameter spiral screw 61 and the long-diameter spiral screw 62 is shown by the sectional view thereof. In other words, the long-diameter spiral screw 62 has a sufficient diameter to stir the entire developer 130, and the short-diameter spiral screw 61 has a sufficient diameter to stir a part ⌈A⌋ around the rotary shaft 60, where the supplied toners relatively tend to collect (i.e., the upper part where the developer collects).

Figure 7:
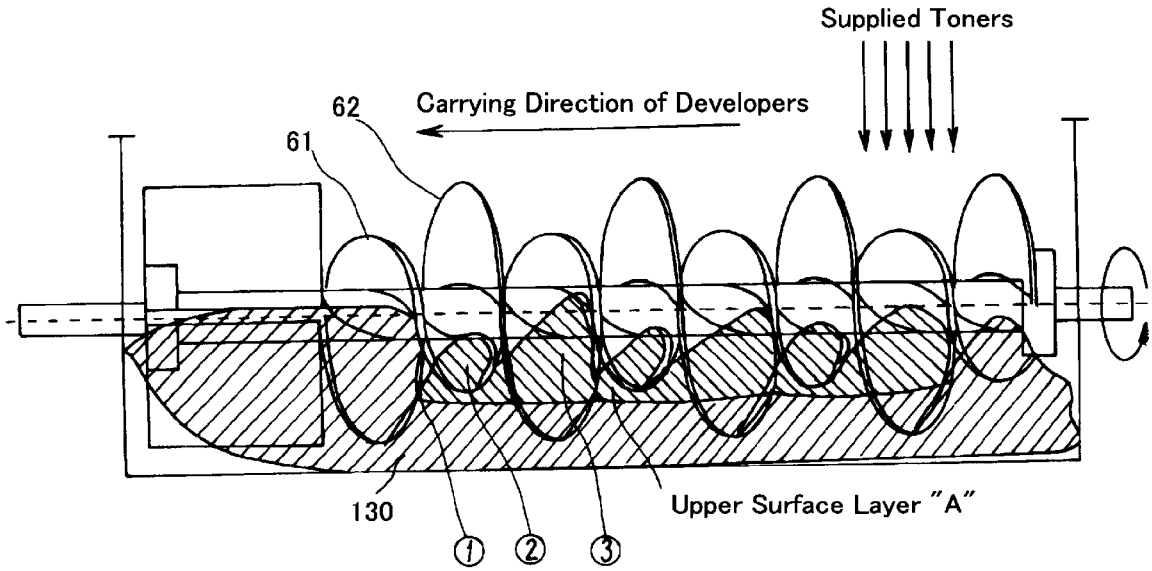
FIG. 7 is an explanatory view of the operation of the stirring screw in FIG. 5.
Figure 8:
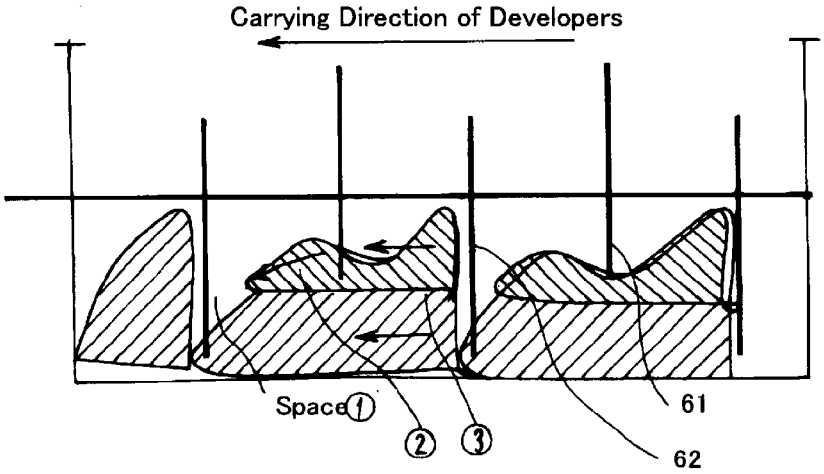
FIG. 8 is a sectional view of the operation of the stirring screw in FIG. 7.
Figure 9A:
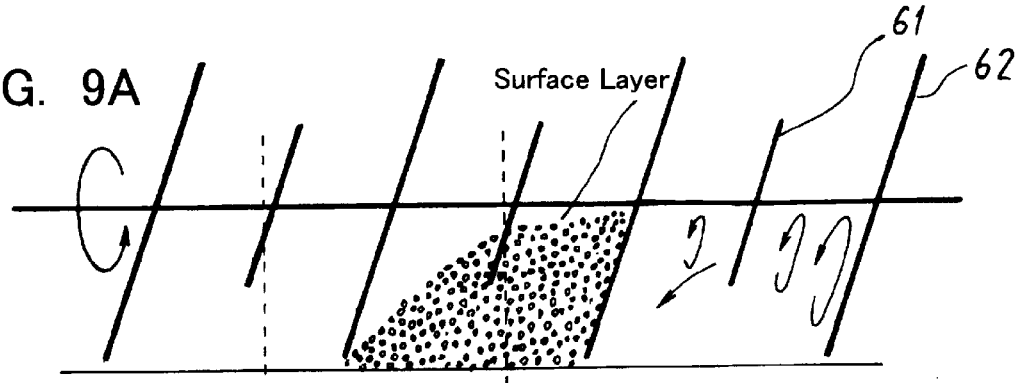
FIGS. 9A, 9B, 9C, 9D are transitional views of the developer's state, while the stirring screw in FIG. 5 is operated.
Figure 9B:
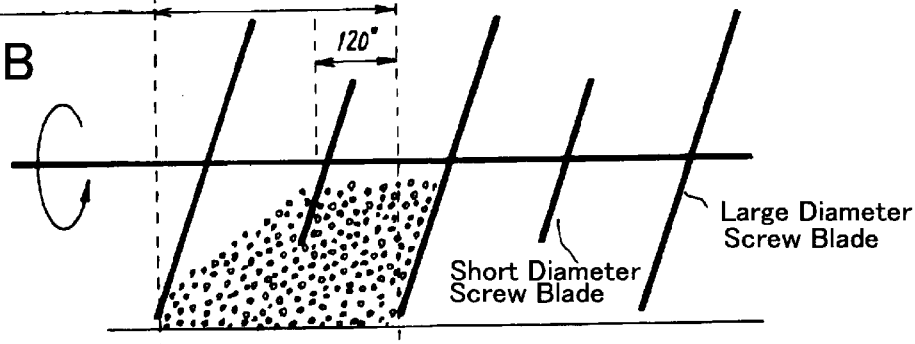
Figure 9C:
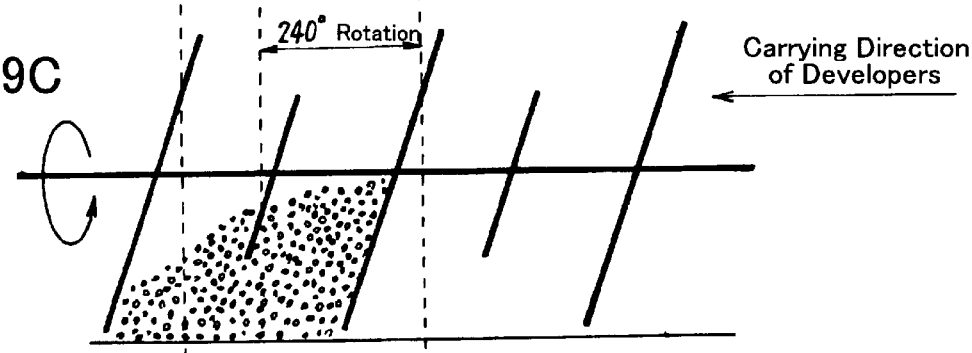
Figure 9D:
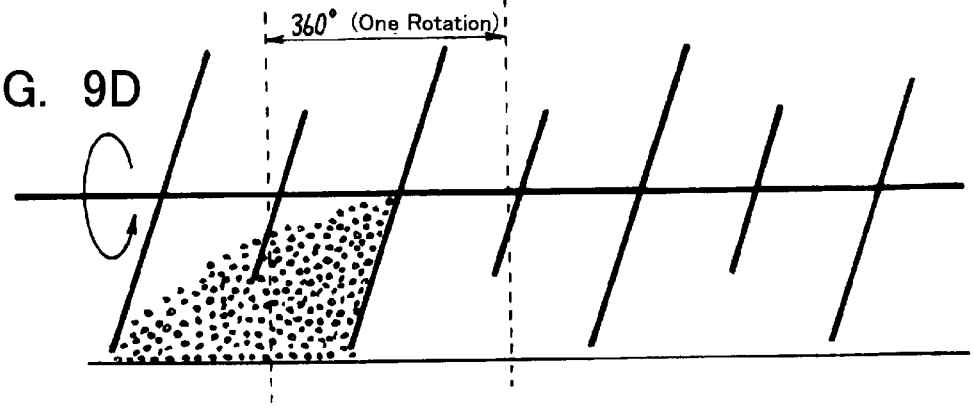

Referring to FIGS. 7 to 10, the operations of the spiral screws 61 and 62 are explanatorily shown. FIG. 7 shows the state of developer 130 when the stirring and carrying screw 6 is rotated, FIG. 8 is a sectional view of the operation of the stirring and carrying screw 6, and FIGS. 9A, B, C, and D show the transition of the developer's states when the stirring and carrying screw 6 is rotated by 120, 240, and 360 degrees.

Referring to FIG. 8, the developer 130 is positioned slantwise between the blades of the long-diameter spiral screw 62, by rotating the long-diameter spiral screw 62, viewing from the sectional view thereof, and a space ① is formed on the back of the next blade of the long-diameter spiral screw 62. As shown in FIGS. 7 and 8, the surface layer ② of the developer 130, which is formed by a blade of the long-diameter spiral screw 62, is carried to the space ① on the back of the next blade of the spiral long-diameter screw 62, while being loosened by a blade of a short-diameter spiral screw blade 61. After the blade of the short-diameter spiral screw 61 loosens the surface layer (2) of the developer 130, the next blade of the long-diameter spiral screw 62 stirs and carries the entire developer 130.

By repeatedly executing this operation, the entire developer 130 can be fully stirred. In FIGS. 9A, 9B, 9C and 9D, the transition of the developer's states are shown, the spiral long-diameter screw 62 stirs and carries the developer 130, while the surface layer ② of the developer 130 are loosened by the blades of the short-diameter spiral screw 61 that are arranged between the blades of the long-diameter spiral screw 62.

The spiral screw 61 has a short diameter, so a space is formed between the bottom of the developing device body 14 and the blade of the short-diameter spiral screw 61. Therefore, the blades of the short-diameter spiral screw 61 come into contact with a heap of the developer 130, which is formed by the blades of the long-diameter spiral screw 62, on the upstream and downstream sides in the developer carrying direction, so that the surface layer ② of the developer 130 can be stirred by rotating the carrying screw 61. The short-diameter spiral screw 61 is extended spirally around the rotary shaft 60, so the developer 130 can be stirred while being carried. Therefore, the short-diameter spiral screw 61 can fully stir the surface layer ② of the developer 130 without exerting a stress on the developer 130, so that the generation of uncharged toners can be prevented and the high-speed image printing quality can be improved.

Figure 10A:
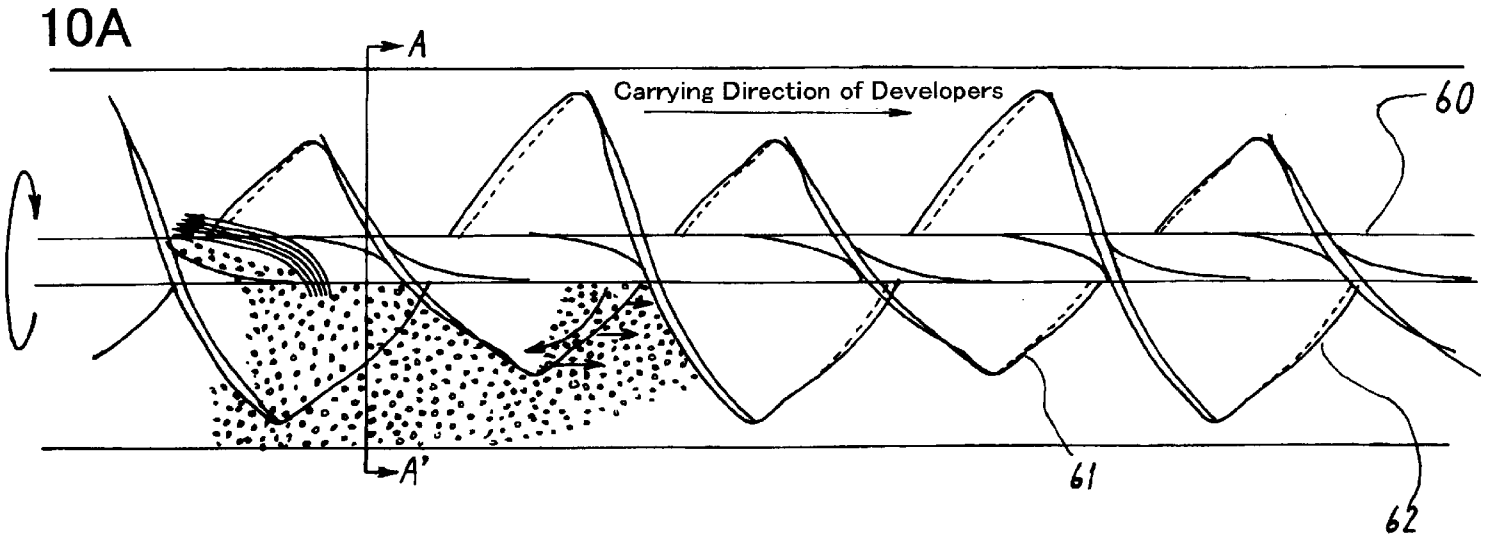
FIG. 10A is a top plan view of the stirring screw.
Figure 10C:
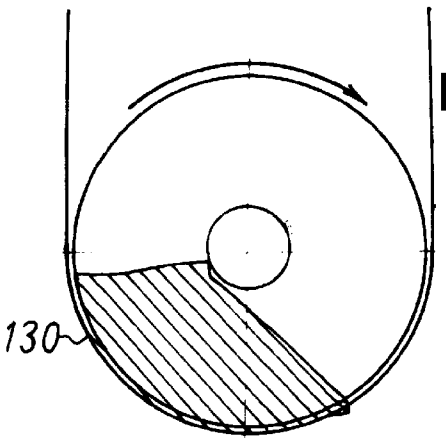
FIG. 10C shows the case in which the stirring screw has no short-diameter spiral screw.
Figure 10B:
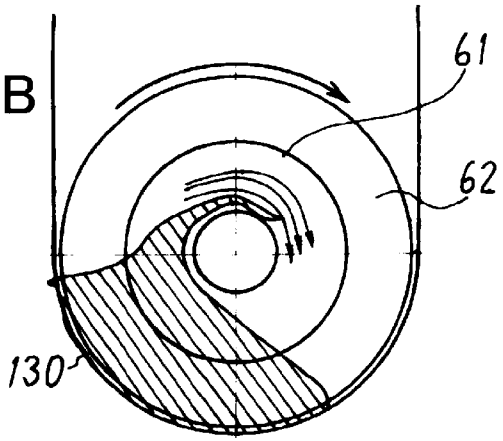
FIG. 10B is a sectional view taken along the arrowed line A—A' of FIG. 10A.

Referring to FIG. 10A as the top plan view of the stirring and carrying screw 6 and FIG. 10B as the sectional view thereof, the surface layer ② of the developer 130 is carried while getting over the rotary shaft 60, by rotating the short-diameter spiral screw 61. This operation enables the efficiency of stirring the developer 130 to be further enhanced. The short-diameter spiral screw 61 enables the efficiency of stirring the developer 130 to be further enhanced without changing the developer carrying speed of the long-diameter spiral screw 62. On the other hand, referring to FIG. 10C, the surface layer ② of the developer 130 is not stirred by rotating only the long-diameter spiral screw 62.

Figure 11:
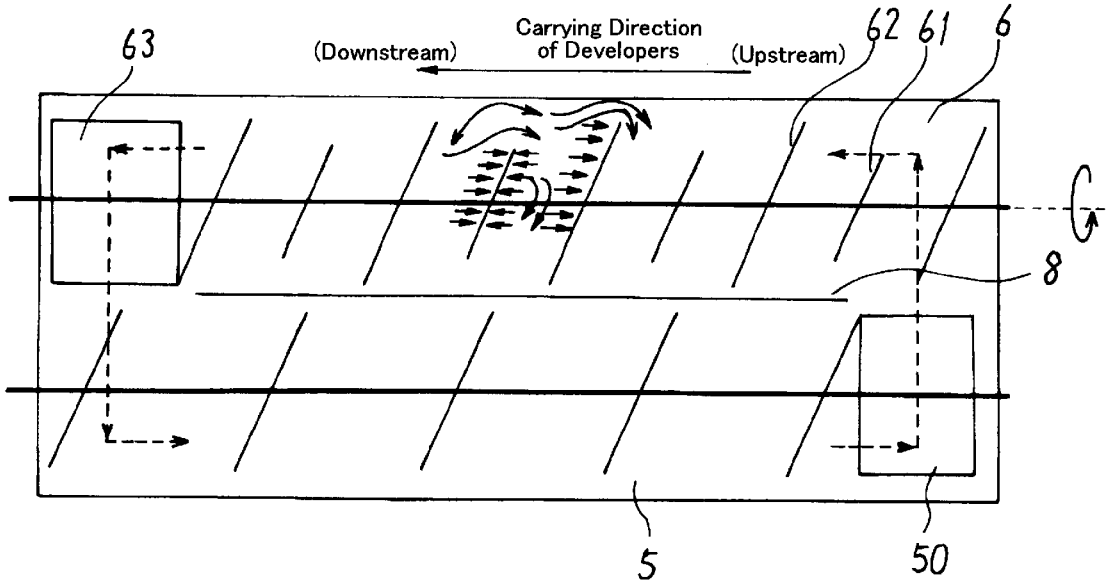
FIG. 11 is an explanatory view of the operation of the stirring screw of the developing device in FIG. 3.
Figure 12:
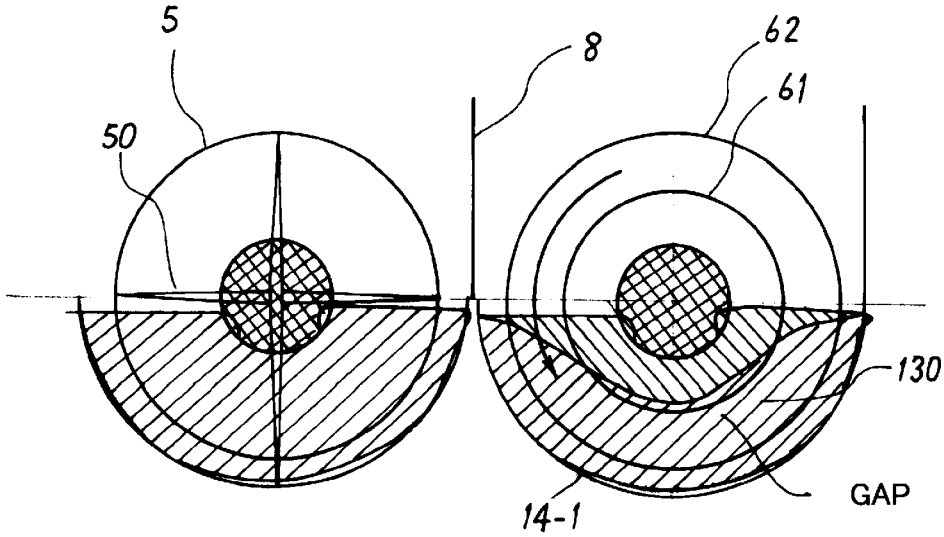
FIG. 12 is a sectional view of the stirring screw in FIG. 11.

FIG. 11 is the top plan view of the stirring and carrying screw 6 and FIG. 12 is the sectional view thereof, when the stirring and carrying screw 6 is used in the developing device body 14 with the constitutions in FIGS. 2 to 4. Referring to FIGS. 11 and 12, the supplied toners from the toner hopper 34 is supplied to and stirred by the stirring paddles 7, and then carried to the stirring and carrying screw 6. The stirring and carrying screw 6 stirs the toners with the developer 130 carried from a carrying screw 5 through a receiving and sending paddle 50 positioned at an end of the partition plate 8, and returns the developer 130 from a receiving and sending paddle 63 positioned at the other end of the partition plate 8, to the carrying screw 5 to circulate the developer 130.

The stirring and carrying screw 6 carries and stirs the developer 130 by rotating the long-diameter spiral screw 62 and the short-diameter spiral screw 61 thereof, so that it can stir the supplied toners with the developer 130 without exerting a stress on the developer 130. Therefore, as shown in FIG. 4, in the case that the toner supply port of the toner hopper 34 is smaller than the width of the developing device body 14, but has a relatively wide opening, to prevent the lumps of toners from being supplied, the toners supplied from the toner hopper 34 to the downstream side in the developer carrying direction of the developing device body 14 can be fully stirred even when the stirring distance of the stirring and carrying screw 6 is short.

Therefore, this developing device can prevent the generation of uncharged toners and improve the quality of the formed image, even when a large amount of toners are consumed and frequently supplied for high-speed printing.

Then, the following explains the relationship in length between the outer diameters of a short-diameter spiral screw blade 61 and a long-diameter spiral screw blade 62. In other words, it is discussed below whether the stirring effect can be improved when the outer diameter of the short-diameter spiral screw blade 61 is shortened by what percent of that of the long-diameter spiral screw blade 62.

The range of values to be set as the outer diameter of the short-diameter spiral screw blade 61 is determined between the lower limit of decreasing the developer amount and the upper limit of increasing the developer amount in the developing device body 14. At this time, the percent of shortening the outer diameter of the short-diameter spiral screw blade 61 is calculated by using (Long-diameter spiral screw blade's outer diameter)−(Screw shaft's diameter)= 100% as the reference expression. The lower limit of decreasing the developer amount indicates the state in which the developer 130 is irregularly supplied onto the developing magnet rolls 1 to 3. On the other hand, the upper limit of increasing the developer amount indicates the state in which the top of the outer diameter of the long-diameter spiral screw blade 62 reaches the surface level of the developer 130. When the surface level of the developer 130 exceeds the top of the outer diameter of the long-diameter spiral screw blade 62, the stirring and carrying screw 6 does not carry the developer volume existing between the surface level of the developer 130 and the top of the outer diameter of the long-diameter spiral screw blade 62.

Then, a test was made under the following conditions to set the outer diameter of the short-diameter spiral screw blade 61, using the developing device body 14 for a high-speed printer consuming a developer of 7.0 kg, as shown in FIG. 3:

[Conditions for the Developing Device Body]

Number of rotations of the stirring and carrying screw 6: 250 rpm

Outer diameter of the long-diameter spiral screw blade 62: ϕ72 mm

Number of rotations of the carrying screw 5: 250 rpm

Outer diameter of the carrying screw blade 5: ϕ72 mm

Number of rotations of the stirring paddle 50 or 63: 120 rpm

Number of rotations of the carrying conveyor magnet roll 4: 193 rpm

Developer/Toner concentration: 4.5 Wt %

Number of rotations of the developing magnet rolls 1 to 3: 550 rpm

Developing blade gap: 0.4 mm

Figure 13:
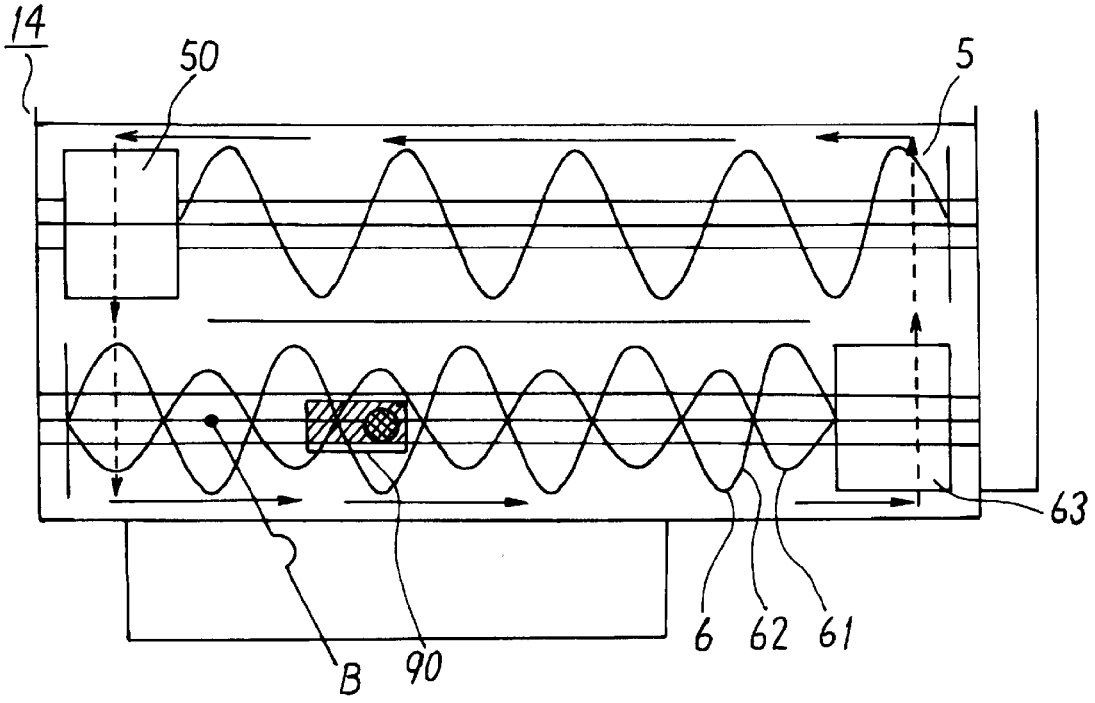
FIG. 13 is a constitutional view of the developing device for measuring the stirring effects to be obtained from the stirring screw according to an embodiment of the present invention.

Referring to FIG. 13, the stirring effect of the short-diameter spiral screw 61 of the stirring and carrying screw 6 combined the long and short diameter spiral screws to same shaft was confirmed, depending on the waveform output from a toner concentration sensor 90 (Toner concentration sensor=Tc sensor). The sensor 90 is arranged in a screw case (bottom plate) of the developing device body 14 for the normal toner concentration control.

As shown in FIG. 13, the stirring effect was confirmed by circulating the developer 130 through the developing device body 14 with only the screws 5 and 6 therein to supply the toners from the upstream side in the developer carrying direction thereof to a position "B" before the toner concentration sensor 90, and by monitoring the waveform output therefrom. However, the amount of toners that can be supplied at one time is 17 g.

Figure 14:
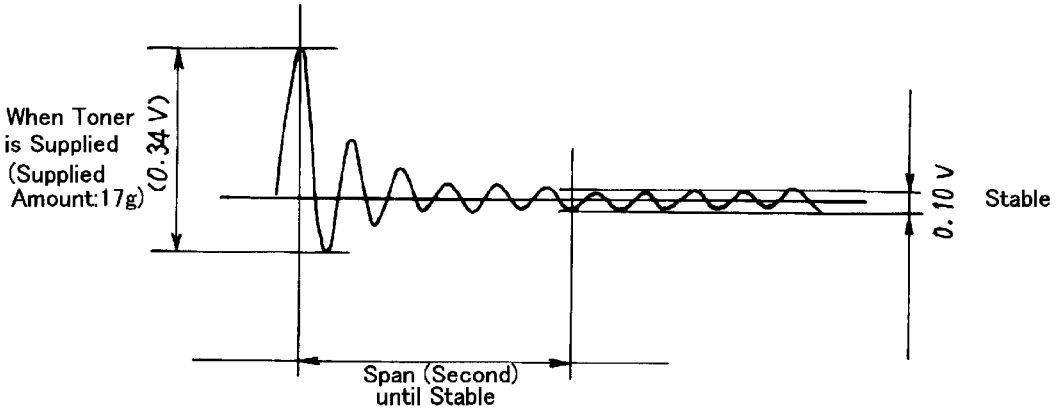
FIG. 14 shows a waveform output by a toner concentration sensor.

The waveform output from the sensor 90 is large in the range of high toner concentrations, but it is stable and low when the toner concentration becomes constant by stirring the toners. At this time, the waveform was monitored with a pen recorder. Referring to FIG. 14, the stirring effect was determined by the time span (seconds) between when the sensor output waveform was large by supplying the toners to the position "B" before the toner concentration sensor 90 and when the toner concentration became constant by fully stirring the toners and the output waveform became stable. In other words, when it takes a short time for a large waveform to change to a small one, a good stirring effect can be obtained, but when it takes a long time, no sufficient effect can be obtained. In this case, it was determined whether the toner output condition was stable when the waveform was output with a voltage of 0.1V or less applied.

Figure 15:
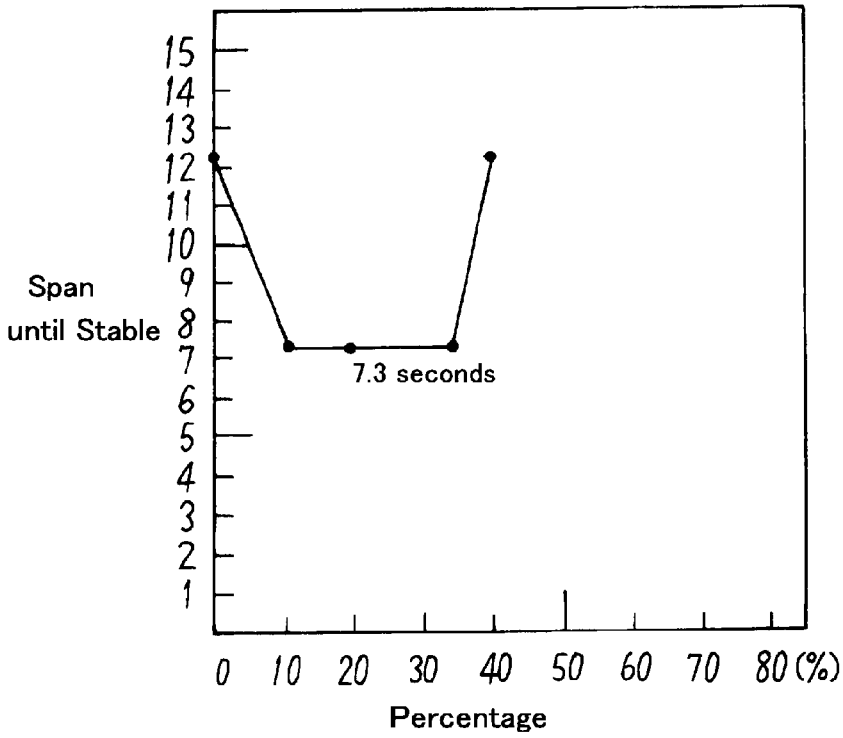
FIG. 15 shows the relationship between the outer diameter of the short-diameter spiral screw and the stirring time, when the developer amount is set to the lower limit.

FIG. 15 shows the relationship between the percent (%) of shortening the short-diameter spiral screw blade's outer diameter (i.e., the percent of setting the short-diameter spiral screw blade's outer diameter shorter than the long-diameter spiral screw blade's) and the result of measuring the time (seconds) of which the output of the Tc sensor 90 is stable, when the developer amount is set to 4.0 kg as the lower limit.

Figure 16:
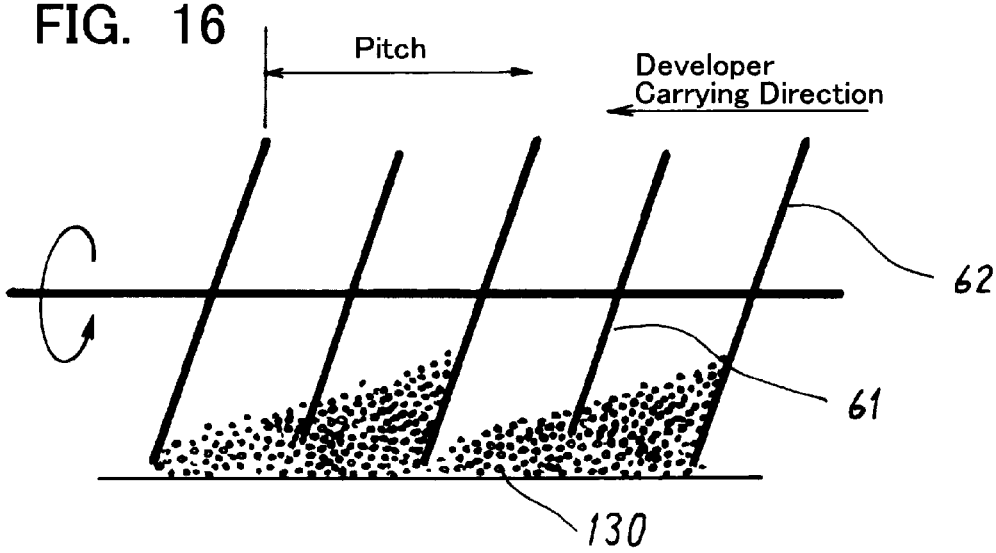
FIG. 16 is an explanatory view of the stirring operation, when the developer amount is set to the lower limit.

FIG. 16 is an explanatory view of the operations of the short-diameter and long-diameter spiral screws.

As shown in the measuring result from FIG. 15, when the short-diameter spiral screw is rotated at the lower limit of decreasing the developer amount with the percent of shortening the outer diameter thereof shortened by 10% to 35% of the long-diameter spiral screw blade's outer diameter, the waveform output from the toner concentration sensor 90 becomes stable 7.3 seconds after the toners supplied. On the contrary, when the short-diameter spiral screw is rotated with the percent of shortening the outer diameter thereof shortened by less than 10% or over 35% of the long-diameter spiral screw blade's outer diameter, the stirring ability is lowered because it takes a long time for the sensor output waveform to be stable.

At the result, a sufficient stirring effect can be obtained when the developer amount is decreased to 4.0 kg as the lower limit, with the percent of shortening the short-diameter spiral screw blade's outer diameter by 10% to 35% of the long-diameter spiral screw blade's. As shown in FIG. 16, no sufficient stirring effect can be obtained, when the percent of shortening the outer diameter of the short-diameter spiral screw blade 61 is less than 10% of that of the long-diameter spiral screw blade 62 and the outer diameter of the screw blade 61 approximates to that of the screw blade 62. Because the developing device body enters the state where a short-diameter spiral screw does not exist and a further long-diameter spiral screw is arranged between the spiral screw 62.

When the short-diameter spiral screw is rotated with the percent of shortening the outer diameter thereof by over 35% of the long-diameter spiral screw blade's outer diameter, no stirring effect can be obtained because the short-diameter spiral screw blades 61 have a few (or no) contacts with the developer 130.

Figure 17:
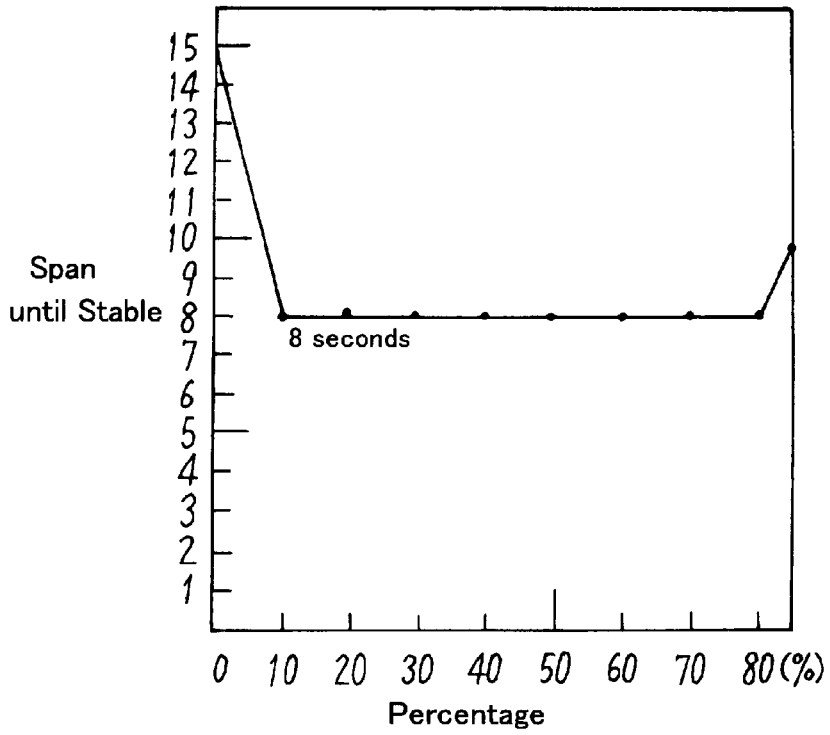
FIG. 17 shows the relationship between the outer diameter of the short-diameter spiral screw and the stirring time, when the developer amount is appropriate.
Figure 18:
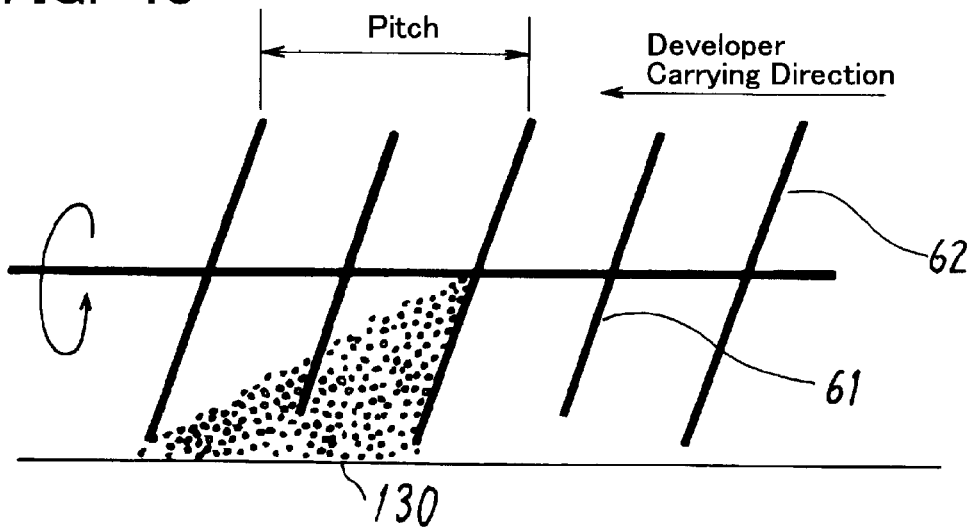
FIG. 18 is an explanatory view of the stirring operation of the stirring screw, when the developer amount is appropriate.
Figure 19:
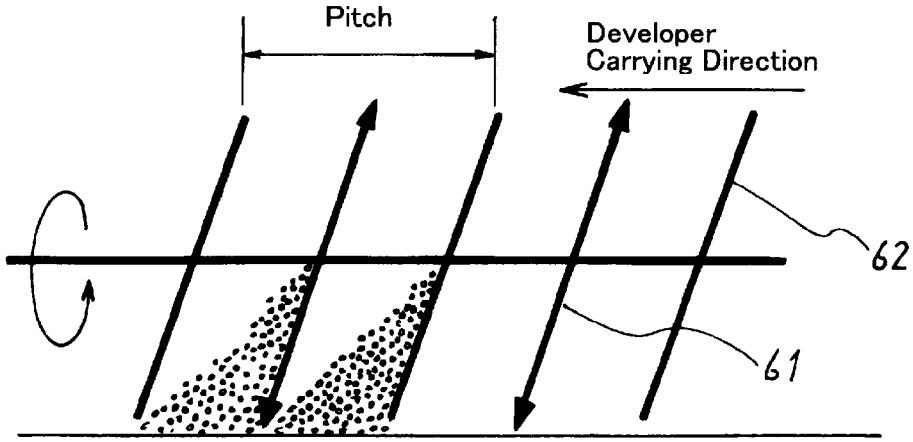
FIG. 19 is an explanatory view of the stirring operation of another stirring screw as an example to be compared.

FIG. 17 shows the relationship between the percent (%) of shortening the short-diameter spiral screw blade's outer diameter (i.e., the percent of setting the short-diameter spiral screw blade's outer diameter shorter than the long-diameter spiral screw blade's) and the result of measuring the time (seconds) of which the output of the Tc sensor 90 is stable, when the developer amount is set to 7.0 kg as an appropriate amount. FIGS. 18 and 19 show the operations of the short-diameter and long-diameter spiral screws.

The result from FIG. 17 indicates that the sensor output waveform becomes stable 8.0 seconds after the toners supplied, when the developer amount is set to 7.0 kg as an appropriate amount with the percent of shortening the short-diameter spiral screw blade's outer diameter by 10% to 80% of the long-diameter spiral screw blade's. In other words, when the developer amount is set to 7.0 kg, there is a wide range of 10% to 80%, between which the short-diameter spiral screw blade s outer diameter can be set shorter than the long-diameter spiral screw blade's to obtain a sufficient stirring effect. However, when the short-diameter spiral screw blade's outer diameter is shortened by less than 10% or over 80% of the long-diameter spiral screw blade's, the stirring ability is lowered.

Referring to FIG. 18, the margin line (surface) of the developer 130 corresponds with the position of the screw shaft, and there is a wide range of is 10% to 80%, to which the short-diameter spiral screw blade's outer diameter can be set shorter than the long-diameter spiral screw blade's to obtain a sufficient stirring effect. On the contrary, as shown in FIG. 19, no stirring effect can be obtained, when the short-diameter spiral screw outer diameter is shortened by less than 10% of the long-diameter spiral screw blade's. Because the developing device body enters the state where the outer diameter of the short-diameter spiral screw blade 61 approaches to that of the long-diameter spiral screw blade 62, a short-diameter spiral screw does not exist, and a long-diameter spiral screw is further arranged between the spiral screw 62.

Furthermore, when the short-diameter spiral screw blade's outer diameter is shortened by over 80% of the long-diameter spiral screw blade's, no stirring effect can be obtained because the developer cannot be fully stirred. This is because a portion of the short-diameter spiral screw blade is not projected highly upward from the screw shaft.

Figure 20:
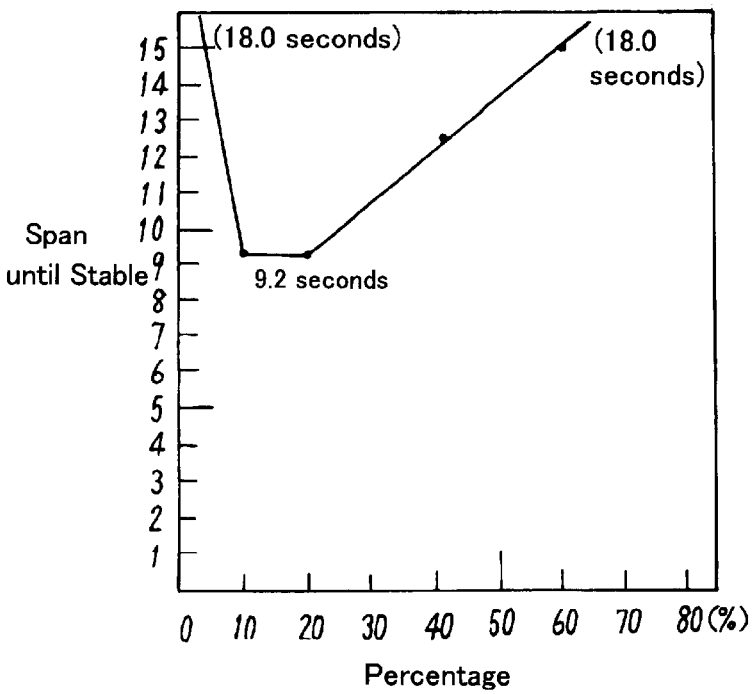
FIG. 20 shows the relationship between the outer diameter of the short-diameter spiral screw and the stirring time, when the developer amount is set to the upper limit.
Figure 21:
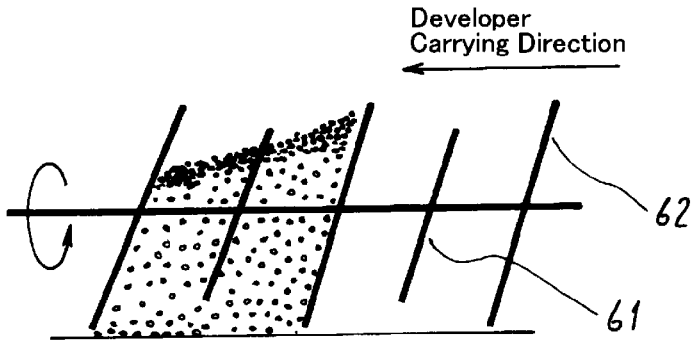
FIG. 21 is an explanatory view of the stirring operation, when the developer amount is set to the upper limit.
Figure 22:
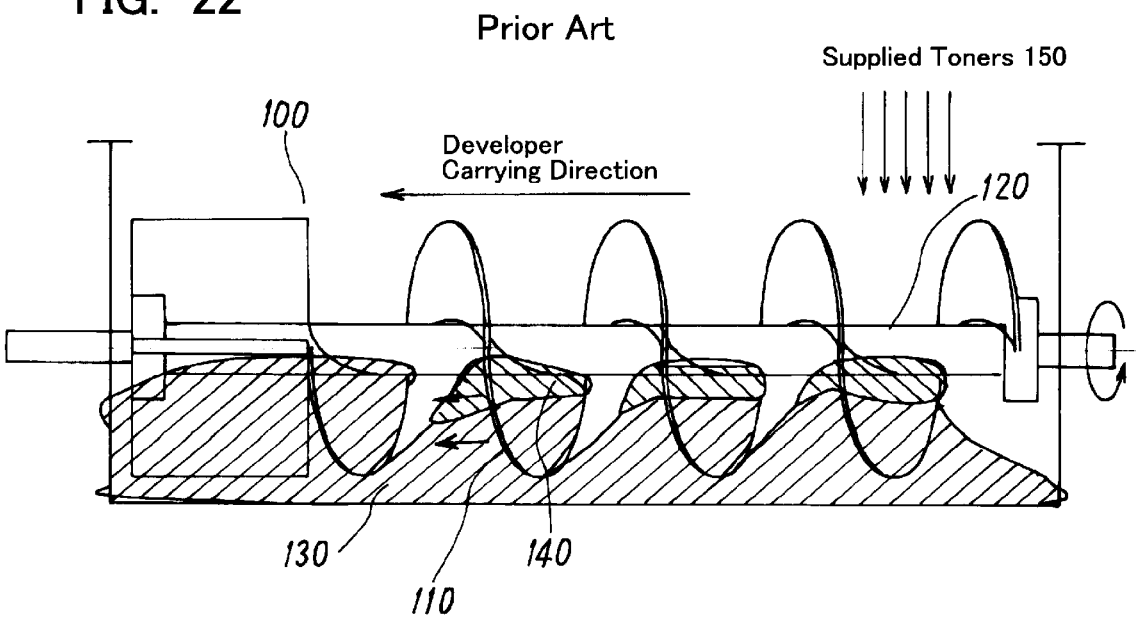
FIG. 22 is an explanatory view of a conventional stirring screw.
Figure 23:
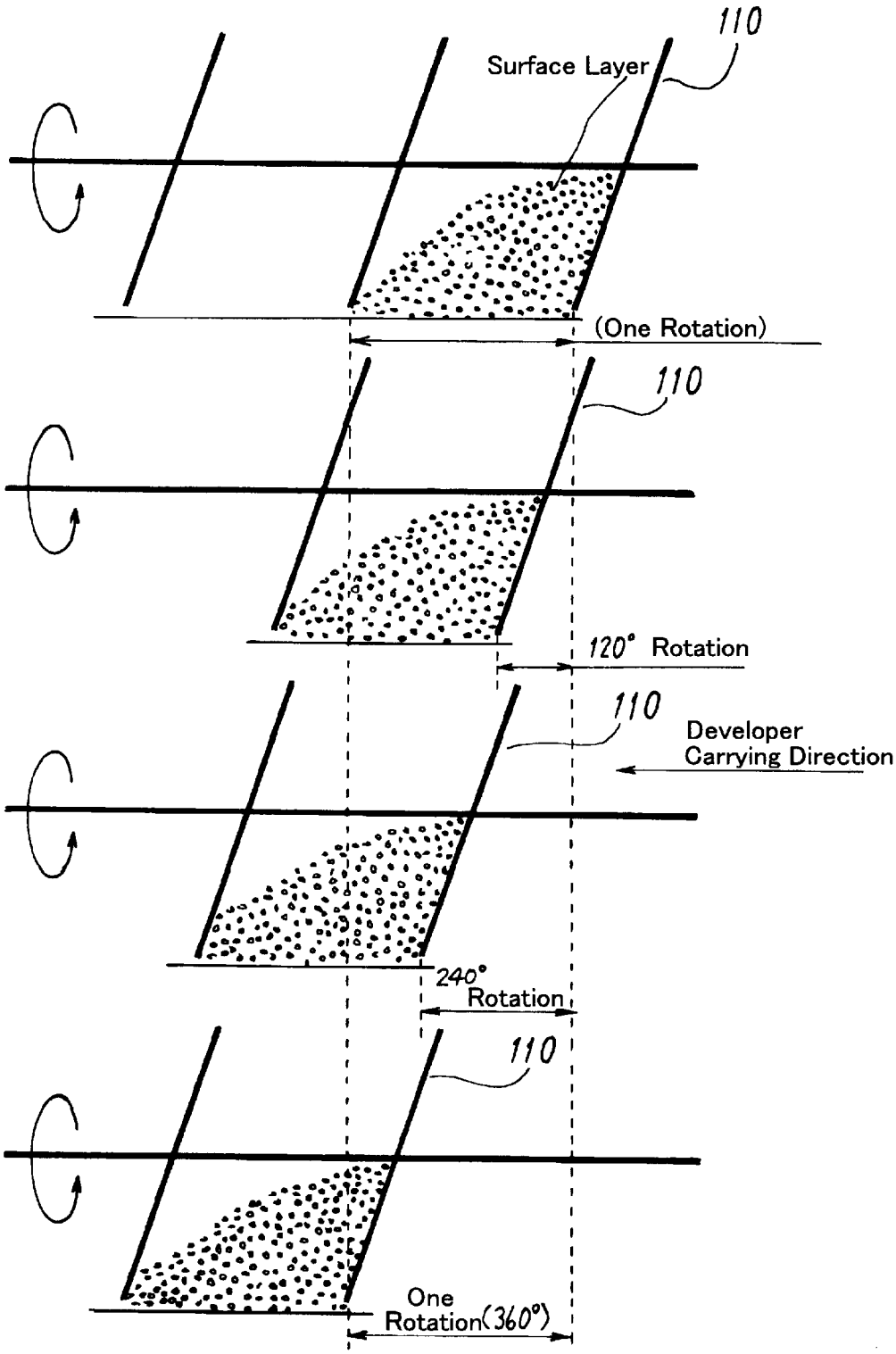
FIG. 23 Prior Art
FIG. 23 is an explanatory view of the stirring operation of the conventional stirring screw.
Figure 24:
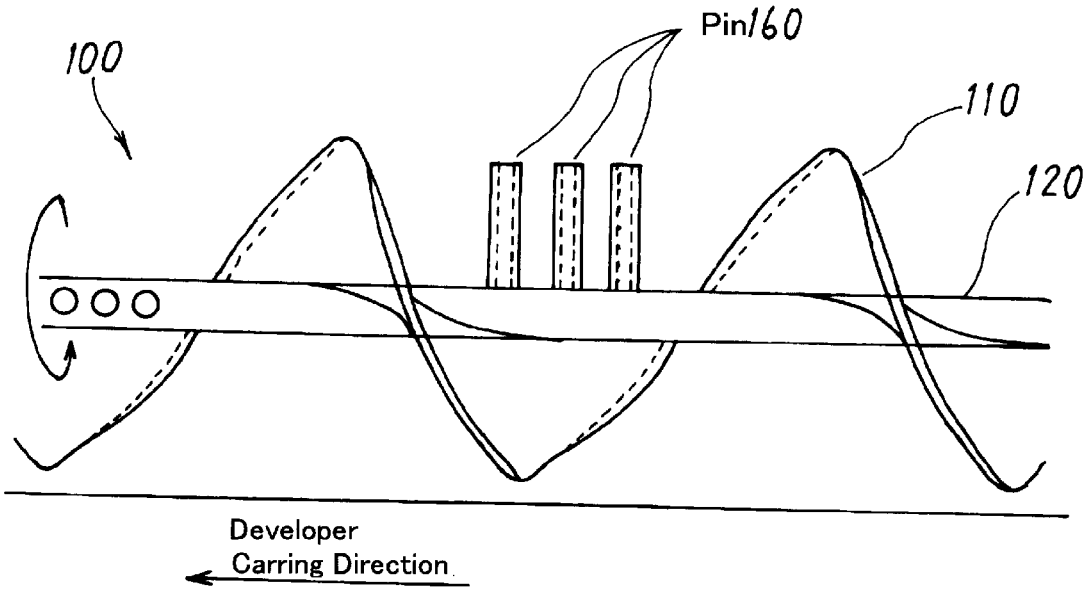
FIG. 24 Prior Art
FIG. 24 is an explanatory view of another conventional stirring screw.

FIG. 20 shows the relationship between the percent (%) of shortening the short-diameter spiral screw blade's outer diameter (i.e., the percent of setting the short-diameter spiral screw blade's outer diameter shorter than the long-diameter spiral screw blade's) and the result of measuring the time (seconds) of which the output of the Tc sensor 90 is stable, when the developer amount is set to 10.0 kg as the upper limit. FIG. 21 shows the operations of the short-diameter and long-diameter spiral screws.

The measuring result of FIG. 20 indicates that when the developer amount is increased up to the upper limit, there is a narrow range of shortening the short-diameter spiral screw blade's outer diameter by 10% to 20% of the long-diameter spiral screw blade's to obtain a sufficient stirring effect. However, the stirring ability is lowered when the short-diameter spiral screw blade's outer diameter is shortened by less than 10% or over 20% of the long-diameter spiral screw blade's. As shown in FIG. 21, when the developer amount is increased up to 10 kg as the upper limit, the margin line (surface) of the developer 130 reaches the top of the spiral long-diameter screw blade's outer diameter. Thus, a sufficient stirring effect can be obtained when the short-diameter spiral screw blade's outer diameter is shortened by 10% to 20% of the long-diameter spiral screw blade's.

On the contrary, when the short-diameter spiral screw blade's outer diameter is shortened by less than 10% of the spiral long-diameter screw blade's, no stirring effect can be obtained because the short-diameter spiral screw blade's outer diameter approximates to the long-diameter spiral screw blade's, and a short-diameter spiral screw does not exist. As shown in FIG. 21, when the short-diameter spiral screw blade's outer diameter is shortened by over 20% of the long-diameter spiral screw blade's, the margin line (surface) of the developer 130 is on a high level. Therefore, the short-diameter spiral screw 61 is put under the developer 130 and cannot stir the surface layer ② of the developer 130 with a high toner concentration. At the result, the short-diameter spiral screw 61 cannot fully stir the developer 130.

It can be judged from the above-described results that a sufficient stirring effect can be obtained when the outer diameter of the short-diameter spiral screw blade 61 is shortened by 10% to 80% of that of the long-diameter spiral screw blade 62. Particularly, when the developer amount is set to an appropriate amount, this range of 10% to 80% is effective. In addition, a sufficient stirring effect can be obtained for the entire developer amount, when the developer amount is set in the range between the upper and lower limits and the outer diameter of the short-diameter spiral screw blade 61 is shortened by 10% to 20% of that of the long-diameter spiral screw blade 62.

[Other Embodiments]

In addition to the above-described embodiments, the following modifications are made in the present invention:

(1) A printer is cited as an example of an image forming apparatus to explain the above-described embodiments of the present invention, but these embodiments can be applied to other image forming apparatus such as a copier and facsimile equipment except the printer.

(2) The two-component developing device for the high-speed printer in FIG. 3 is cited as an example to explain the two-component developing device, but this embodiment can be applied to other two-component developing devices.

(3) A carrying screw 5 arranged in the developing device body can be constituted of a stirring and carrying screw 6.

As explained above, the following effects can be expected according to the present invention:

(1) By arranging a short-diameter spiral screw as a member for stirring the surface layer of the developer on a long-diameter spiral screw, the developer can be stirred while being carried on the face of a short-diameter spiral screw blade. Therefore, the short-diameter spiral screw can fully stir the surface layer of the developer without exerting a stress on the developer.

(2) The short-diameter spiral screw enables the generation of uncharged toners to be prevented and the high-speed image printing quality to be improved, even when both the toner supply amount and the toner supply count are increased for high-speed printing.

It is further understood by those skilled in the art that the foregoing descriptions are preferred embodiments of the disclosed invention and that various changes and modifications may be made in the invention without departing from the spirit and scope thereof.

What is claimed is:

1. A two-component developing device for developing a latent image on a latent image body, comprising:

a developing carrying member for carrying a developer containing carriers and toners, to the latent image body; and a stirring screw for stirring supplied toners with the developer;

wherein said stirring screw comprises;

a screw shaft;

a short-diameter spiral screw blade with a relatively short diameter; and a long-diameter spiral screw blade with a relatively long diameter, which are alternately wound around the same screw shaft;

wherein both spiral directions of said short-diameter spiral blade and said long-diameter spiral blade are the same so as to convey said two-component developer to a same direction.

2. The two-component developing device according to claim 1, wherein an outer diameter of the short-diameter spiral screw blade is in a range from 10% to 80% shorter than that of the long-diameter spiral screw blade.

3. The two-component developing device according to claim 2, wherein the outer diameter of the short-diameter spiral screw blade is in a range from 10% to 20% shorter than that of the long-diameter spiral screw blade.

4. The two-component developing device according to claim 1, further comprising;

a toner hopper for supplying toners to the stirring screw.

5. The two-component developing device according to claim 1, wherein the carrying member for carrying the developer in a direction opposite to a developer carrying direction of the stirring screw; and wherein the carrying member is arranged parallel to the stirring screw.

6. An image forming apparatus, comprising:

a latent image body;

a latent image forming unit for forming a latent image on the latent image body;

a two-component developing device for developing the latent image on the latent image body; and a transfer device for transferring the developed image on the latent image body, to a medium;

wherein said two-component developing device comprises;

a developer carrying member for carrying a developer containing carriers and toners, to the latent image body; and a stirring screw for stirring supplied toners with the developer and comprises a screw shaft, a short-diameter spiral screw blade with a relatively short diameter, and a long-diameter spiral screw blade with a relatively long diameter, which are alternately wound around the same screw shaft;

wherein both spiral directions of said short-diameter spiral blade and said long-diameter spiral blade are the same so as to convey said two-component developer to a same direction.

7. The image forming apparatus according to claim 6, wherein an outer diameter of a short-diameter spiral screw blade is in a range from 10% to 80% shorter than that of a long-diameter spiral screw blade.

8. The image forming apparatus according to claim 6, wherein the outer diameter of the short-diameter spiral screw blade is in a range from 10% to 20% shorter than that of the long-diameter spiral screw blade.

9. The image forming apparatus according to claim 6 further comprising;

a toner hopper for supplying the toners to the stirring screw.

10. The image forming apparatus according to claim 6, wherein:

a carrying screw for carrying the developer in a direction opposite to a developer carrying direction of the stirring screw;

wherein the carrying screw is arranged in parallel to the stirring screw.

11. A stirring screw used in a two-component developing device for stirring supplied toners with two-component developer, comprising;

a screw shaft;

a short-diameter spiral screw blade with a relatively short diameter; and a long diameter spiral screw blade with a relatively long diameter, which are alternately wound around the same screw shaft;

wherein both spiral directions of said short-diameter spiral blade and said long-diameter spiral blade are the same so as to convey said two-component developer to a same direction.

12. The stirring screw according to claim 11, wherein an outer diameter of a short-diameter spiral screw blade is in a range from 10% to 80% shorter than that of a long-diameter spiral screw blade.

13. The stirring screw according to claim 11, wherein the outer diameter of the short-diameter spiral screw blade is in a range from 10% to 20% shorter than that of the long-diameter spiral screw blade.

* * * * *